US008512484B2

(12) United States Patent
Laudenklos et al.

(10) Patent No.: US 8,512,484 B2
(45) Date of Patent: Aug. 20, 2013

(54) PASSIVATING MEANS, SURFACE TREATMENT MEANS, SURFACE TREATMENT SPRAY MEANS AND METHOD FOR TREATING METALLIC SURFACES OF WORK PIECES OR CAST MOLDS

(75) Inventors: Manfred Laudenklos, Schöneck (DE); Stephan Beer, Lehrensteinsfeld (DE); Matthias Reihmann, Hemsbach (DE)

(73) Assignees: KS Aluminium-Technologie GmbH, Neckarsulm (DE); Gelita AG, Eberbach (DE)

( * ) Notice: Subject to any disclaimer, the term of this patent is extended or adjusted under 35 U.S.C. 154(b) by 369 days.

(21) Appl. No.: 12/864,237

(22) PCT Filed: Jan. 26, 2009

(86) PCT No.: PCT/EP2009/050846

§ 371 (c)(1), (2), (4) Date: Jul. 23, 2010

(87) PCT Pub. No.: WO2009/092817

PCT Pub. Date: Jul. 30, 2009

(65) Prior Publication Data

US 2010/0297344 A1 Nov. 25, 2010

(30) Foreign Application Priority Data

Jan. 26, 2008 (DE) ..... 10 2008 006 147

(51) Int. Cl.
*C23C 22/08* (2006.01)
*C23C 22/00* (2006.01)

(52) U.S. Cl.
USPC ..... 148/253; 106/14.12

(58) Field of Classification Search
USPC ..... 106/14.11, 14.12; 148/253–263
See application file for complete search history.

(56) References Cited

U.S. PATENT DOCUMENTS

| | | | | |
|---|---|---|---|---|
| 2002/0045010 | A1 | 4/2002 | Rohrbaugh et al. | |
| 2003/0162671 | A1 | 8/2003 | Kalota et al. | |
| 2010/0304129 | A1 * | 12/2010 | Laudenklos | 428/329 |

FOREIGN PATENT DOCUMENTS

| | | | |
|---|---|---|---|
| CH | 320 338 | | 4/1957 |
| CN | 1 115 794 | | 1/1996 |
| CN | 1 132 802 | | 10/1996 |
| DE | 34 03 660 | | 8/1985 |
| DE | 100 12 492 | A1 | 9/2001 |
| DE | 10 2005 042475 | | 3/2007 |
| WO | WO 98/08919 | A2 | 3/1998 |
| WO | WO 2005-033365 | | 4/2005 |
| WO | WO 2007-028621 | | 3/2007 |

* cited by examiner

*Primary Examiner* — Lois Zheng
(74) *Attorney, Agent, or Firm* — Norman B. Thot

(57) ABSTRACT

A passivating agent for metallic surfaces of workpieces or casting molds includes an aqueous phosphate solution with metal ions and a gelatin.

2 Claims, No Drawings

PASSIVATING MEANS, SURFACE TREATMENT MEANS, SURFACE TREATMENT SPRAY MEANS AND METHOD FOR TREATING METALLIC SURFACES OF WORK PIECES OR CAST MOLDS

CROSS REFERENCE TO PRIOR APPLICATIONS

This application is a U.S. National Phase application under 35 U.S.C. §371 of International Application No. PCT/EP2009/050846, filed on Jan. 26, 2009 and which claims benefit to German Patent Application No. 10 2008 006 147.6, filed on Jan. 26, 2008. The International Application was published in German on Jul. 30, 2009 as WO 2009/092817 A1 under PCT Article 21(2).

FIELD

The present invention relates to a passivating agent provided for metallic surfaces of workpieces or casting molds comprising an aqueous phosphate solution with metal ions. The present invention also relates to a surface treatment agent and a spray-type surface treatment agent provided for cleaning and passivating metallic surfaces of workpieces or casting molds comprising the passivating agent. The present invention also relates to a method for the treatment of metallic surfaces of workpieces or casting molds by use of the surface treatment agent or the spray-type surface treatment agent.

BACKGROUND

Casting molds as used in low-pressure casting, gravity casting, squeeze casting or pressure-die casting, are usually made of hot-work steels because the recrystallization and/or transformation temperatures of these steels are distinctly above those of the molten light metal materials. In the casting processes, in order to obtain smooth surfaces on the cast components to be produced, it is required that the liquid melt, for example, in the form of a light metal alloy such as an aluminum alloy, will not adhere to the surface of the casting mold. For this purpose, the surfaces of the casting molds are provided with release agents or with facings to prevent the molten metal from sticking to the casting mold.

To ensure that the release agents and respectively the facings adhere to the tool surfaces, the latter first have to be cleaned and, in the given case, be passivated.

By passivating, a non-metallic protective layer is generated on the metallic material in order to slow down corrosion or to prevent corrosion as much as possible. In this regard, passivating by phosphating is of special importance. Phosphating is a widespread method of surface technology wherein, by a chemical reaction between the metallic surface of the workpiece and an aqueous phosphate solution, a conversion layer of tightly adhering metal phosphates is formed. Phosphating serves to protect from corrosion and generate a diffusion barrier. Additionally, it is thus possible to enhance adhesion, for example, in case of subsequently applied layers, and to reduce wear.

For phosphating, use is made both of phosphate baths and of phosphate spray systems. In both cases, it is required to clean the surface of the casting mold or of the workpiece prior to phosphating.

The cleaning process is performed, for example, by use of a high-pressure water jet which, via a rotating nozzle, is directed onto the workpiece at a pressure ranging from 1750 to 3000 bar. Disadvantageous herein is that the water contact of the cleaned workpiece causes corrosion and that organic and inorganic residues from the jet water remains on the surface. The high pressures leads to massive wear of the pistons and valves of the water-jet system and incurs high costs.

For this reason, cleaning processes performed at lower pressures of, for example, 200 bar are also known. Although these processes can be carried out with reduced wear, the cleaning effect deteriorates correspondingly.

It is also known to perform the cleaning of pressure die casting molds by uses of granulates which are blasted under pressure onto the workpiece. Herein, use is made, for instance, of nutshells or glass pearls. For the cleaning of low-pressure casting molds or gravity casting molds, the granulate used can also be provided in the form of steel, corundum or ceramics. Apart from an additional increase of mechanical wear of the surface, undercut portions of the treated component will be partly inaccessible. This gives rise to dimensional inaccuracies in subsequent casting processes and to impurities on the surface of the mold due to coating with foreign particles from the cycle.

When depositing a facing, for example, with sodium silicate binders, subsequent to such a cleaning process, the surfaces, which for the above-mentioned reasons have been insufficiently cleaned and passivated, will cause adhesion problems, giving rise to lattice defects on the surface of the facing after deposition. Particularly during a subsequent thermal treatment, a danger exists that the facing will peel off from the treated surface, or in casting molds, during subsequent casting processes, there is a danger of intermetallic welding on the lattice defects so that the mold cannot be accurately separated from the cast workpiece.

When using known cooling/separating agent systems for pressure die casting molds, problems also exist in the wetting of insufficiently cleaned surfaces or corroded surfaces of the mold. In the casting process, this will also cause intermetallic connections on the surface of the mold.

To avoid these advantages, it is thus necessary to perform a post-cleaning on the surface of the mold to obtain a metallurgically pure surface.

Known methods for cleaning and passivating are usually carried out in baths or by spraying treatment.

When the treatment is performed in a bath, the casting mold or the workpiece will, after the jet treatment, first be immersed into a pickling bath for removal of organic residues and oxides at temperatures from 40°-90° by means of inorganic acids and suitable surface-active agents. This process is followed by a deep cleaning process in the bath by ultrasonic means, whereupon the workpiece or the casting mold will be immersed into a further bath for rinsing and neutralizing. Subsequently, the workpiece must be dried and, in a further process step, be activated in the bath, before the phosphating is performed, for example, by means of zinc phosphate at 40-70° C. or manganese phosphate at 70-90° C. The workpiece or the casting mold are thereafter neutralized and dried. A disadvantage of these processes consists in the required long dwelling times in the baths, especially in case of large components such as pressure die casting tools. In correspondence thereto, large amounts of energy are needed for reaching and maintaining the required temperatures. Maintaining the clean condition of the bath in order to maintain the necessary bath parameters is also very burdensome because, between the individual baths, impurities will be generated, making it necessary to remove accumulating residues. Depending on the dimensioning of the components, the size of the base may also have to be adapted.

In spray treatment, the pickling bath is followed by a high-pressure cleaning process and then by rinsing and neutralizing with a suitable spray solution. After the subsequent drying and heating of the component, a spray activation is carried out at increased temperature before the phosphating is performed by means of a heated spray solution at 40-70° C. in case of zinc phosphate, and at 70-90° C. in case of manganese phosphate. This is also followed by the further steps of neutralizing and drying the workpiece or the casting mold. Similar to the treatment in a bath, the spray treatment also entails a relatively high energy consumption for reaching the required temperatures, particularly in case of correspondingly high mass ratios, so that the method is economically disadvantageous. There also exists a high logistic expenditure in the treatment cycle of the components to be treated.

Further still, the components treated with known passivating agents often suffer from an insufficient thermal shock resistance which is caused particularly by lattice defects in the structure of the passivating layer.

To improve the above situation, DE-34 03 660 A1 describes a passivating agent consisting of an aqueous solution of aluminum hydrogen phosphate and organic polymers which form a film under thermal influence. As organic polymers, use is made herein of acrylic or epoxy resins. When heated, however, these lacquers will lose their organic components. A special disadvantage of this agent resides in that, in case of several casting processes, lattice defects will be caused, entailing the risk of welding connections to a cast component. The thermal shock resistance is still also insufficient.

SUMMARY

An aspect of the present invention is to provide a passivating agent which is adapted to achieve a long durability of the phosphate layer while avoiding lattice defects to the largest possible extent. Another aspect of the present invention is to provide a surface treatment agent and a spray-type surface treatment agent comprising such a passivating agent, by which the bothersome cleaning process can be simplified. Another aspect of the present invention is to provide a correspondingly simplified method for treatment of surfaces by such agents.

In an embodiment, the present invention provides for a passivating agent for metallic surfaces of workpieces or casting molds which includes an aqueous phosphate solution with metal ions and a gelatin.

DETAILED DESCRIPTION

While the phosphates have the effect, in the known manner, that iron phosphate generated along with the basic material, in combination with the metallic ions of the phosphate system on the free lattice sites and respectively grain boundaries, will form—during the treatment of components or casting molds of steel—a protective layer on the surface that will act as a corrosion protection and adhesive for the layers to be applied, the gelatin in such an agent will act as a dispersion agent and as a potential equalization system and will improve the diffusion barrier in a previously unknown manner. The electrochemical reaction is influenced by the gelatin in such a manner that the phosphating takes place at room temperature. Thereby, the energy demand for phosphating is considerably lowered.

In an embodiment, the present invention provides for gelatins whose redox potential has been set to the effect that the gold number of the gelatin is smaller than 50 μmol Au/g of gelatin. The use of such gelatins makes it possible to reach particularly good results with regard to the adhesion of the passivating layer and the thermal shock resistance of a component treated therewith.

The aqueous phosphate solution with the metal ions can, for example, be an aqueous orthophosphate solution, wherein the orthophosphates comprise one or a plurality of the compounds zinc phosphate, aluminum phosphate, manganese phosphate, titanium phosphate, calcium phosphate, boron phosphate or iron phosphate. In phosphating, these compounds have been found to be useful for achieving smooth surfaces.

In an embodiment of the present invention, the passivating agent has the following composition: 0.1% by weight to 5% by weight of gelatin, 5% by weight to 50% by weight of orthophosphates, the rest being water. With such a composition, there is obtained an optimal balance and potential equalization between the individual elements of the system so that, already with small quantities of the individual substances used, good results can be reached in passivation.

The simplifying the presently known cleaning and passivating methods is also achieved by a surface treatment agent comprising such a passivating agent which additionally includes non-ionic surface-active agents, lactic acid and a citric acid monohydrate. When using such a surface treatment agent, preparatory cleaning steps can be completely or at least partly omitted since it is already at room temperature that rust and organic components, such as, for example, grease, dirt, cracked organics etc., will be detached from the surface. The non-ionic surface-active agents included in the surface treatment agent is effective to reduce the surface tension and, in combination with the organic acids, to undermine the impurities on the surface, so that these impurities will be detached and respectively dissolved, which allows for an especially good and largely faultless binding of the phosphate system to the metallic surface. The agent can be applied by immersion of the workpiece or the casting mold into a corresponding bath at room temperature.

The surface treatment agent can, for example, have the following composition:

- 0.1 to 5% by weight, for example, 0.41 to 1% by weight of gelatin;
- 5 to 50% by weight, for example, 5 to 10% by weight of orthophosphates;
- 0.5 to 5% by weight, for example, 0.5 to 2.5% by weight of lactic acid;
- 0.5 to 5% by weight, for example, 0.5 to 2.5% by weight of citric acid monohydrate;
- 0.1 to 3% by weight, for example, 0.5 to 2% by weight of non-ionic surface-active agents; and
- the rest being distilled water.

Using this composition, good results have been accomplished with regard to the thermal shock resistance of the coated component. Defects in the lattice are eliminated, thus obtaining long-lasting protection from corrosion.

In an embodiment of the present invention, the surface treatment agent additionally comprises molybdenum disulfide and/or bismuth. A quantity of 0.01 to 5% by weight, for example, 0.02 to 0.04% by weight of molybdenum disulfide and/or 0.01 to 5% by weight, for example, 0.02 to 0.04% by weight of bismuth, can be added. In passivating, the molybdenum sulfide or the bismuth will be chemically bound in the matrix of the surface. Thereby, the heat resistance and the wear resistance of the casting mold or of the workpiece can be further increased, and the lubricating effect can be improved.

In an embodiment, the present invention provides for a spray-type surface treatment agent wherein the surface treatment agent of the present invention additionally comprises up to 60% by weight of a thickening agent. This provides for sprayability, thus obviating the need for a bothersome cleaning of several baths. Contamination of the surface treatment agent, as might occur when performing a treatment in baths, is excluded.

In an embodiment, the present invention provides for a method wherein the workpiece or the casting mold are be immersed into a bath of the inventive surface treatment agent, or the inventive spray-type surface treatment agent is sprayed onto the surface of the workpiece or the casting mold. Precleaning and post-cleaning steps can thereby be omitted completely or at least partially so that the throughput time in the production of corrosion-preventing layers can be noticeably reduced. The surfaces treated in this manner can be cleaned to the point of being absolutely free of residues and be passivated at the same time so that each further surface layer can be applied in a uniform and permanent manner. Onto the thus cleaned and passivated surface layer, one can apply, for example, separating agents, facings or also lacquers. Accordingly, the cleaning and passivation provided by the present invention will increase the useful life and the functionality of the thus treated workpieces and molds.

In an embodiment of the present invention, the workpiece or the mold can subsequently be heated to 200° C. Starting from this temperature, the inorganic components, metallic ions and mineral elements of the gelatin will be bound as a uniformly distributed nanosystem into the chemical compound which is undergoing a polymerization. The overall system will solidify by polycondensation.

In an embodiment of the method for low-pressure casting molds of the present invention, after immersion into the surface treatment agent or after spraying the spray-type surface treatment agent, a facing can be applied onto the cleaned and passivated surface of the casting mold. Said facing can, for example, be a sodium or potassium water glass facing which will be applied onto the surface, thereby smoothing the surface and additionally protecting it from thermal stresses.

The facing can, for example, be applied at a mold temperature of 250° C. The heating required for applying the facing leads to polycondensation of the phosphate system and its organic components. The gelatin of the surface treatment agent will be bound into the chemical compound of the metal with the phosphate system, thus further increasing the adhesive strength. A separate heating of the surface treatment agent is thus not necessary.

It is evident that the described method wherein a passivating and respectively surface treatment agent or spray-type surface treatment agent is used, makes it possible to omit various method steps and to reduce energy consumption. Nonetheless, the surfaces of the casting molds or of the treated workpieces will be enhanced with regard to adhesive strength, promotion of adhesion and thermal shock resistance, thus allowing a long-term protection from corrosion.

Some methods according to the present invention wherein use is made of the spray-type surface treatment agent of the present invention, will hereinafter be described with reference to exemplary embodiments for surface treatment of casting molds and workpieces.

EXAMPLE 1

The workpiece used was a non-precleaned, non-derusted and non-degreased test metal sheet of hot-working steel. For producing a surface treatment agent according to the present invention, 1% of GELITA NOVOTEC® gelatin FP200 was dissolved in advance in 14% of distilled water. For this purpose, the gelatin was first swollen in distilled water, at room temperature, for about twenty minutes and then dissolved at a temperature of 60° C. At this temperature, 0.03% of molybdenum sulfide was dispersed in the medium. Thereafter, citric acid (0.7%), lactic acid (0.7%), phosphoric acid (1.4%) and an aqueous manganese phosphate solution of the type Brünofix GAM 5624 (36%) were mixed and introduced into the suspension. The flowability of the spray-type surface treatment agent was set by use of a nearly equivalent portion of a thickening agent—comprising non-ionic tensides—of the type Ardrox 6085 so that a spray-type surface treatment agent in accordance with the present invention was produced.

The test metal sheet, while arranged in a vertical position, was fully sprayed with the spray-type surface treatment agent. After a brief exposure time of 10 minutes, the metal sheet was washed by water and dried. Subsequent to cleaning, the metal sheet comprised a continuous black layer consisting of manganese phosphate and molybdenum phosphate. No additional heating of the metal sheet was required. The metal sheet was largely free of lattice defects so that a high corrosion resistance was reached.

EXAMPLE 2

A pressure die casting mold was cleaned and passivated by a spray-type surface treatment agent according to the present invention. For producing the surface treatment agent, 1% of GELITA NOVOTEC® gelatin FP200 was swollen in advance, at room temperature, in 14% of distilled water for about 20 minutes and then dissolved at a temperature of 60° C. At this temperature, 0.03% of molybdenum disulfide was dispersed in the medium. Thereafter, citric acid (0.7%), lactic acid (0.7%), phosphoric acid (1.4%) and an aqueous manganese phosphate solution of the type Brünofix GAM 5624 (36%) were mixed and introduced into the suspension. The flowability of the spray-type surface treatment agent was set by use of a nearly equivalent portion of thickening agent—again comprising non-ionic tensides—of the type Ardrox 6085 so that a spray-type surface treatment agent in accordance with the present invention was produced.

The casting mold was treated at room temperature by spraying the spray-type surface treatment agent onto it. After an exposure time of ten minutes, the cleaning residues were washed off. Again, there formed a uniform layer of manganese phosphate and molybdenum sulfide. Then, in the preheating phase and the balancing phase, the casting mold was tempered in the casting machine for four hours at 200° C. In the process, a continuous layer of manganese phosphate and molybdenum sulfide was generated.

For examining the thermal shock resistance, test metal sheets coated in the same manner and made from a material identical to that of the casting mold were heated for one hour at 800° C. and subsequently quenched in water at room temperature. No lattice defects were observed on the phosphate layer. There was proven an extremely good adherence of the layer on the casting mold and, thus, there was reached an extraordinarily good thermal shock resistance.

EXAMPLE 3

A low-pressure die casting mold was treated by a spray-type surface treatment agent according to the present invention. For producing this spray-type surface treatment agent, again 1% of GELITA NOVOTEC® gelatin FP200 was dissolved in advance in 14% of distilled water. For this purpose, the gelatin was again first swollen at room temperature in distilled water for about 20 minutes and was then dissolved at a temperature of 60° C. Thereafter, citric acid (0.7%), lactic acid (0.7%), phosphoric acid (1.4%) and Brünofix Z 5526 (36%), an aqueous zinc phosphate solution, were mixed and introduced into the suspension. Also in this example, the flowability of the spray-type surface treatment agent was set by use of the nearly equivalent portion of thickening agent—comprising non-ionic tensides—of the type Ardrox 6085.

The casting mold was treated at room temperature by spraying the spray-type surface treatment agent onto it. After an exposure time of ten minutes, the cleaning residues were washed off. Then, the casting mold was tempered for four hours at 250° C. for application of a water-glass-bound facing.

For examining the adhesive effect, a water-glass-bound facing was applied at a casting temperature of 250° C. After 86 casting processes, the surface still presented a coating free of lattice defects. This demonstrates an excellent effect of the inventive spray-type surface treatment agent as an adhesive and a diffusion barrier with very good corrosion resistance. Usually, for example, without the surface treatment agent of the present invention, components subjected to higher temperatures, such as the cylinder spindles, must be provided with fresh facing substance after every sixth casting process.

EXAMPLE 4

A squeeze casting mold was sprayed by a spray-type surface treatment agent according to the present invention. For producing this cleaning agent, 1% of GELITA NOVOTEC® gelatin FP200 was dissolved in advance in distilled water. For this purpose, the gelatin was again first swollen at room temperature in distilled water for about twenty minutes and was then dissolved at a temperature of 60° C. At this temperature, 0.03% of molybdenum disulfide was dispersed in the medium. Thereafter, citric acid (0.7%), lactic acid (0.7%), phosphoric acid (1.4%) and Brünofix GAM 5624 (36%) were mixed and introduced into the suspension. Again, the flowability of the spray-type surface treatment agent of the present invention was set by use of a nearly equivalent portion of thickening agent—comprising non-ionic tensides—of the type Ardrox 6085.

The casting mold was treated at room temperature by spraying the cleaning agent onto it. After an exposure time of ten minutes, the cleaning residues were washed off. Again, there formed a uniform layer of manganese phosphate and molybdenum sulfide. In the preheating phase and the balancing phase, the casting mold was tempered in the casting machine for four hours at 200° C.

For examining the thermal shock resistance, test metal sheets coated in the same manner and made from a material identical to that of the casting mold were heated for one hour at 800° C. and subsequently quenched in water at room temperature. No lattice defects were observed on the phosphate layer. There was observed an extremely good adherence of the layer on the casting mold and, thus, an extraordinarily good thermal shock resistance was reached.

The spray-type surface treatment agent did not cause caking in the casting process, while no need existed to use additional cooling or cooling/separating agents. The method for treatment of the surfaces is considerably facilitated, and the throughput times are correspondingly shortened. Treatment of the casting molds after each casting process is no longer necessary.

The present invention is not restricted to the above described embodiments. Thus, similar effects will be obtained when using correspondingly formulated surface treatment agents in the cleaning and passivating of the casting molds and workpieces within an immersion bath. It is also possible to perform exclusively a passivation by use of an inventive passivating agent after a preceding cleaning process. Such a surface treatment will lead to an increase of the effect of the metal phosphate layer as an adhesive and a diffusion barrier. This is brought about particularly by the fixed binding of the phosphate system to the metallic surface due to the effect of the gelatin as a dispersing agent and a potential balancing system and due to the occupation of lattice defects.

The present invention is not limited to embodiments described herein; reference should be had to the appended claims.

The invention claimed is:

1. A passivating agent for metallic surfaces of workpieces or casting molds, the passivating agent consisting of:

5% to 50% by weight of orthophosphates;

0.1% to 5% by weight of a gelatin; and water, wherein a redox potential of the gelatin is set so that a gold number of the gelatin is smaller than 50 μmol Au/g of gelatin.

2. The passivating agent as recited in claim 1, wherein the orthophosphates comprise at least one of the compounds zinc phosphate, aluminum phosphate, manganese phosphate, titanium phosphate, calcium phosphate, boron phosphate and iron phosphate.

* * * * *